US005766430A

United States Patent [19]

Mehler

[11] Patent Number: 5,766,430

[45] Date of Patent: Jun. 16, 1998

[54] CONDUCTIVE ANODE BASKET WITH SUBMERGED ELECTRICAL CONNECTION

[76] Inventor: Vern A. Mehler, 18030 Bariger Pl., South Bend, Ind. 46637

[21] Appl. No.: 660,605

[22] Filed: Jun. 6, 1996

[51] Int. Cl.[6] ..... C25B 9/00

[52] U.S. Cl. ..... 204/259; 204/280; 204/284; 204/285; 204/287; 204/297 R; 204/297 W

[58] Field of Search ..... 204/259, 285, 204/287, 284, 280, 297 R, 297 W

[56] References Cited

U.S. PATENT DOCUMENTS 1,792,998 2/1931 Melish ..... 204/285

4,039,403 8/1977 Astley et al. ..... 204/287

4,610,773 9/1986 Teruko Takayasu ..... 204/285

*Primary Examiner*—Bruce F. Bell

*Attorney, Agent, or Firm*—Baker & Daniels

[57] ABSTRACT

An anode basket according to the present invention for use in electroplating operations includes a container for suspending anode metal in plating solution. The container has mesh walls formed of conductive, corrosion resistant material and is connected to an electrical power source by a wire attached to the container at a location below the surface of the plating solution.

8 Claims, 3 Drawing Sheets

CONDUCTIVE ANODE BASKET WITH SUBMERGED ELECTRICAL CONNECTION

The present invention relates to an anode basket used in electroplating operations.

BACKGROUND OF THE INVENTION

Conventional anodic electroplating operations use a metal anode bar supported above or suspended in a tank of plating solution. An anode basket formed of an electrically conductive metal is suspended from the bar by conductive hangers and submerged in the plating solution. Anode metal is placed in the anode basket and dissolved and ionized by the charged solution to give off positive metal ions. The ions are plated as solid metal onto the cathode target objects.

During the electroplating process, large amounts of electrical energy are passed into and through the anode bar and anode basket. Under high electrical current, the resistance of the connection between the anode bar and the hangers causes energy loss in the form of sparking, hot spots, and burning. The hangers move slightly and cause intermittent conductivity, exaggerating the arcing and compounding the associated power loss during periods of non-conductivity. The contact areas eventually corrode and further degrade the electrically conductive properties of the hangers.

Conventional methods have taught forming the anode bar and anode basket with a protective outer coating of corrosion resistant metal, such as titanium, to reduce the above-mentioned problems. However, none of these methods provide an efficient and economical system which can be reused with minimal cleaning. In U.S. Pat. No. 5,340,456, a titanium rod is connected to an elongated titanium grid to form a complete anode electrode. The anode electrode is inserted into a pliant, shape returning mesh sock which ensures that the anode metal deposited within the sock maintains contact with the electrode. The electrode and sock are then submerged into the plating solution which has enhanced heat dissipating properties. This method provides greatly improved conductivity, however, some of the materials suitable for forming the sock can withstand only a limited operating temperature range. Other sock configurations become clogged over time and require periodic cleaning. Furthermore, only a limited volume of anode metal can be loaded per sock since the individual pieces of anode metal, typically spherical in shape, are supported within the limited volume of the sock in a column arrangement.

SUMMARY OF THE INVENTION

The anode basket of this invention provides for an electrically conductive, corrosion resistant metal container which is submerged in the plating solution and which has a highly efficient electrically conductive connection to a cable routed to a power source. The container is preferably formed in the shape of an elongated box of titanium metal mesh which accepts a relatively high volume of anode metal. The bottom of the container preferably tapers to accommodate partially dissolved anode metal pieces.

The cable connected to the container is insulated and is attached at one end to the container at a location which, during operation, is submerged in the plating solution. One end of a conductive sleeve is crimped over the cable end and the other end of the sleeve is crimped over a titanium rod which is attached to the container. The sleeve and its connections between the cable and the rod are enclosed within an insulating material.

Accordingly, it is an object of this invention to provide an anode basket which enhances the rate at which the anode metal is dissolved and ionized during plating.

Another object is to provide an electrode basket which exhibits superior electrical conductivity and eliminates power loss from arcing and burning.

Yet another object of the invention is to provide an anode basket which eliminates the need for frequent cleaning.

Another object is to provide an anode basket which can withstand high temperature operation.

Another object is to provide an anode basket which extends the length of operational time between loads of anode metal.

BRIEF DESCRIPTION OF THE DRAWINGS

The above-mentioned and other objects and advantages of this invention, and the manner of attaining them, will become more apparent and the invention will be better understood by reference to the following description of embodiments of the invention taken in conjunction with the accompanying drawings, wherein.

Figure 1:
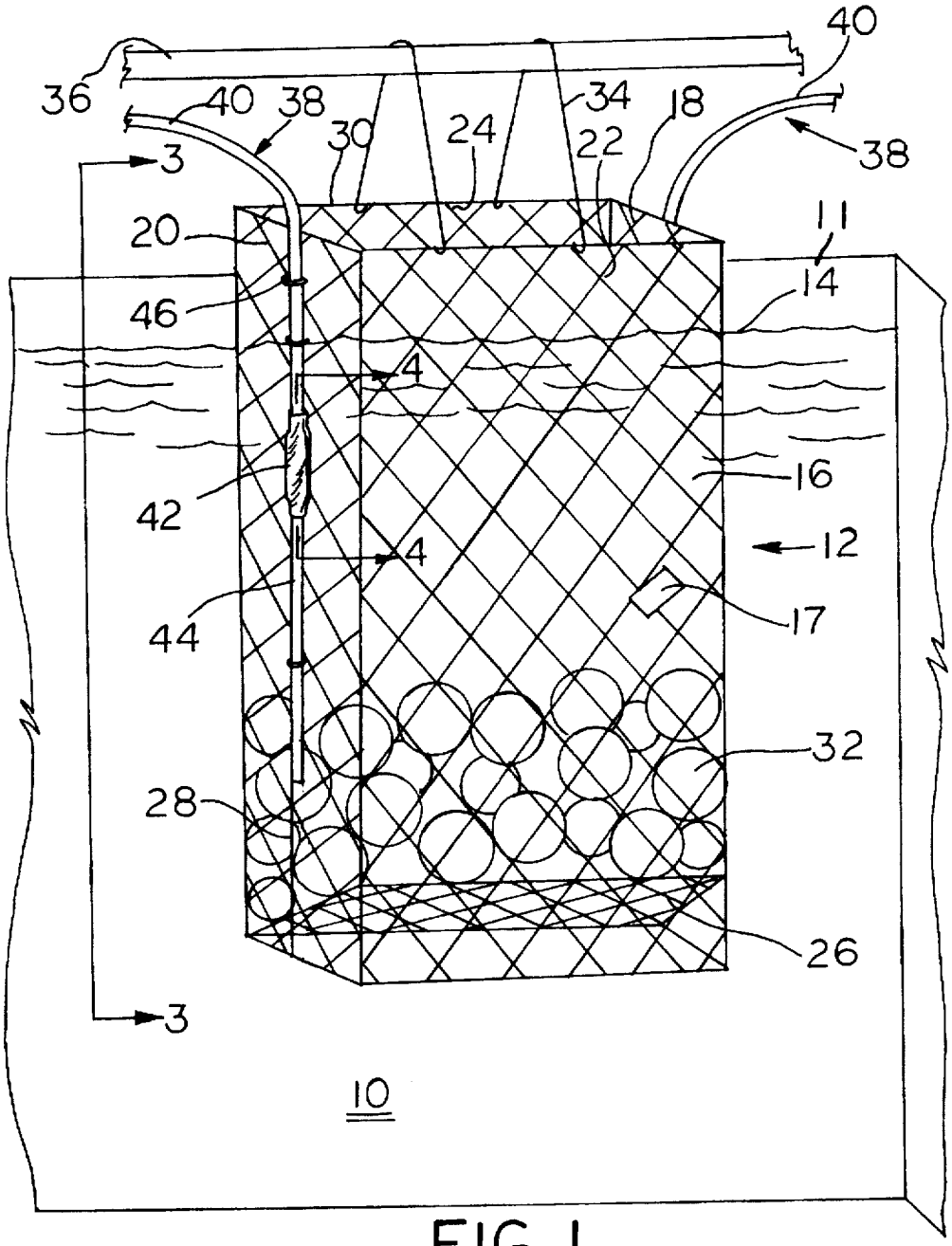
FIG. 1 is a fragmented perspective view of an electroplating tank using the anode basket of the present invention.

Corresponding reference characters indicate corresponding parts throughout the several views. Although the drawings represent an embodiment of the present invention, the drawings are not necessarily to scale and certain features may be exaggerated in order to better illustrate and explain the present invention.

DESCRIPTION OF THE INVENTION

The embodiment herein described is not intended to be exhaustive or to limit the invention to the precise form disclosed. Rather, the embodiment selected for the description is disclosed so that others skilled in the art may utilize its teachings.

Figure 2:
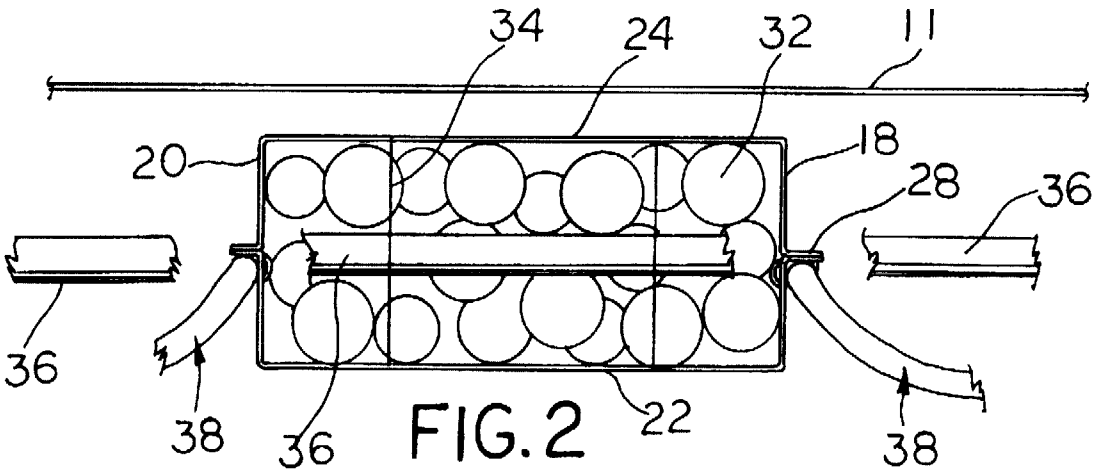
FIG. 2 is a top plan view of the electroplating tank of FIG. 1.
Figure 3:
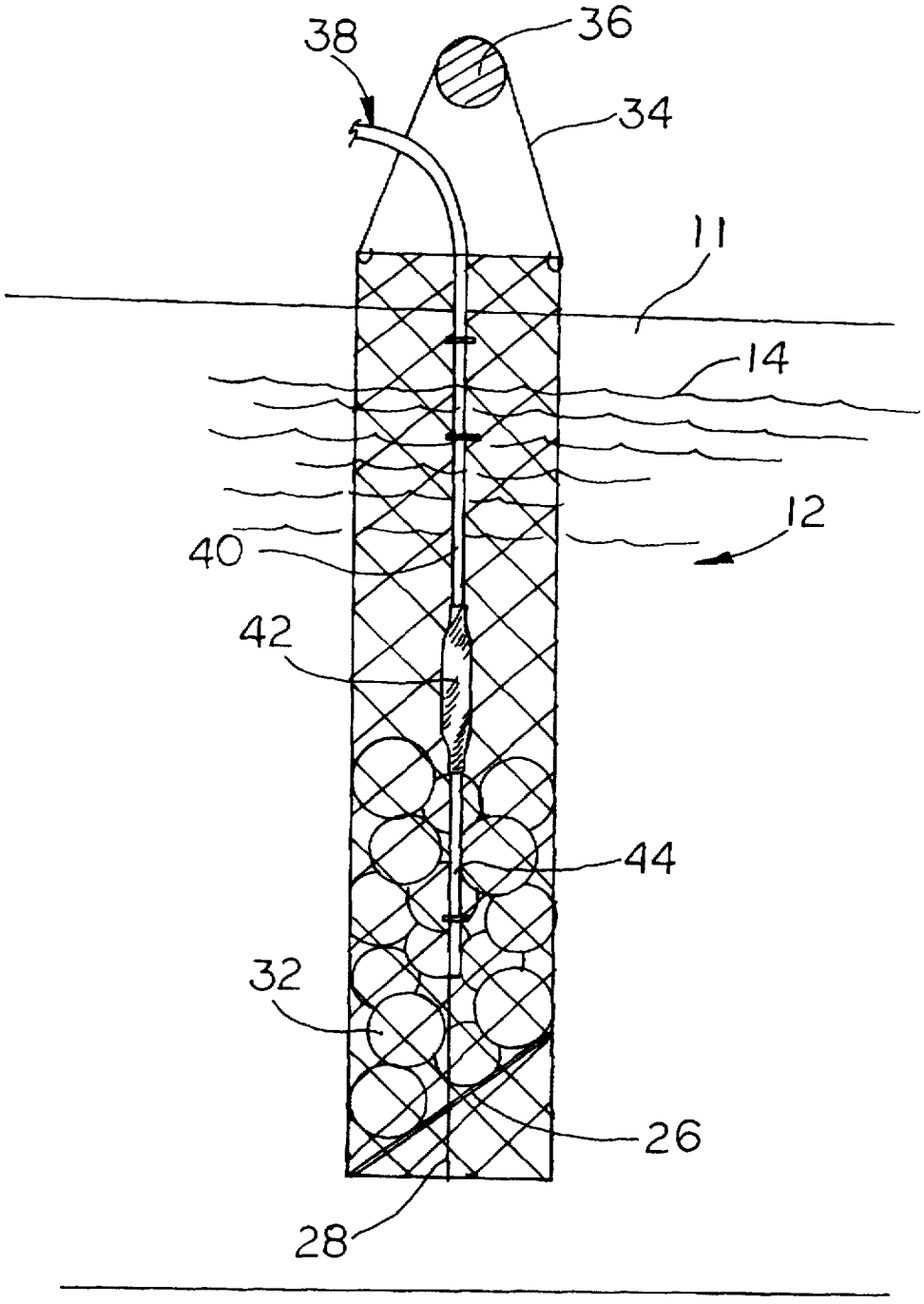
FIG. 3 is a fragmented elevation view as seen from line 3—3 of FIG. 1.

Referring to FIGS. 1–3, reference numeral 10 refers generally to an electroplating tank which utilizes the improved anode basket 12 of this invention. Tank 10 is filled with plating solution 14, typically an aqueous metal salt solution containing ions of the metal being plated which most frequently includes copper or zinc.

Anode basket 12 includes a container 16 which is preferably formed of an open mesh, rigid, non-corrosive, electrically conductive metal, such as titanium or equivalent metal which resists salt corrosion, having a plurality of apertures 17. Container 16 is of a generally rectangular shape with generally parallel sidewalls 18, 20, front wall 22, and rear wall 24, and an angled bottom wall 26. In an exemplary embodiment, container 16 is constructed by bending the mesh metal into trough-shaped halves having outwardly bent flanges 28 as best seen in FIG. 2. Flanges 28 are attached together, such as by welding. Bottom wall 26 is welded to the connected halves and extends between sidewalls 18, 20 and at an angle between front wall 22 and rear wall 24. Top 30 of container 16 is open to receive loads of anode metal pieces 32. Hangers 34 are attached between front wall 22 and rear wall 24 and serve to suspend container 16 in the plating solution 14 from a support 36 mounted above tank 11.

Two cables 38 connect container 16 to a power source (not shown) which provides sufficient electrical current to facilitate electroplating according to principles well known to those skilled in the art. As shown in FIG. 1, cables 38 are routed on the sides of container 16 along flanges 28. Each cable 38 is attached to container 16 at a location which is submerged in the plating solution 14 during operation of the present invention, and includes insulated wire 40, splice 42, and rod 44. Splice 42 joins wire 40 to rod 44 as described in further detail below. Substantially the entire length of rod 44, which is preferably comprised of a non-corrosive metal such as titanium, is attached as by welding to flange 28. Fasteners 46 provide further mechanical support to secure cable 38 to container 16. The free end of cable 38 is routed as the user desires to the electrical power source. As should be apparent to one skilled in the art, any reasonable number of cables 38 could be attached to container 16 in this manner.

Figure 4:
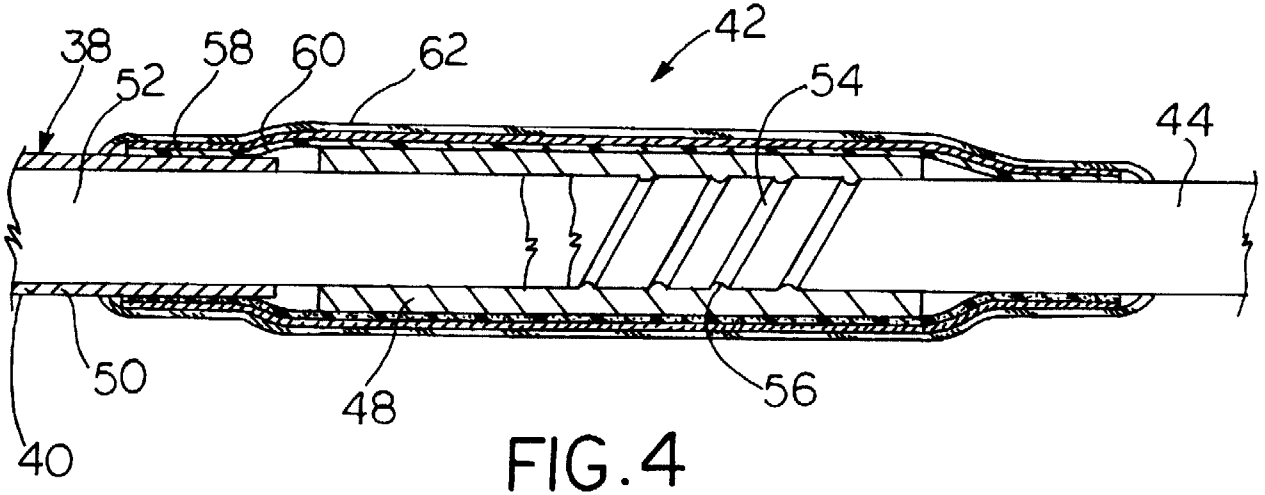
FIG. 4 is a fragmented, detailed cross-sectional view taken along line 4—4 of FIG. 1.

FIG. 4 shows splice 42 which is generally formed by securing wire 40 and rod 44 into opposite ends of a conductive, cylindrical sleeve 48. The insulation 50 of wire 40 is removed at the end of wire 40 to expose the metal core 52, typically copper. A portion of core 52 is then inserted into one end of sleeve 48. One end of rod 44 is scored or threaded to form helical grooves 54. The grooved end of rod 44 is fitted into the opposite end of sleeve 48. Sleeve 48 is formed of a metal, such as copper, which is sufficiently malleable to be rolled formed and pressed into rod grooves 54, thus providing improved mechanical and electrical connection between rod 44 and sleeve 48. Sleeve 48 is crimped about core 52 of wire 40. An insulator 58, such as a rubber tube, fits over sleeve 48 as shown in FIG. 4 to thereby provide a non-conductive, liquid impenetrable material encapsulating the splice 42, to protect splice 42 from the corrosive effects of solution 14. Splice 42 is further protected by a silicone tape 60 applied over insulator 58 and plastic shrink wrap 62, such as a polyolefin material, applied over tape 60.

Mode of Operation

In a typical electroplating operation, negatively charged electrons flow from the cathode through solution 14 to the anode, which in the present invention includes container 16 and rods 44. Anode metal 32 loaded in container 16 in contact its walls 18, 20, 22, 24 and 26 is dissolved and the positive ions enter the plating solution 14 where they flow toward the cathode target (not shown). The positive ions meet the negative ions at the cathode and cause the reduction of the aqueous ions to solid metal which is deposited on the cathode according to principles well understood by those skilled in the art.

Each piece of anode metal 32 remains in contact with container 16 either directly or through contact with other pieces of anode metal 32. Even as anode metal 32 pieces dissolve during the plating operation and decrease in size as shown in FIG. 3, anode metal 32 remains in contact with container 16 because of the inclined orientation of bottom wall 26 until the pieces become substantially dissolved and fall through apertures 17. The elongated rectangular shape of container 16 holds a substantial quantity of anode metal pieces 32 and ensures that the pieces of anode metal 32, especially those near bottom 26 of container 16, are pressed against walls 18, 20, 22, 24 and 26 by the weight of other pieces. This allows for maximum conductivity at all times by reducing resistance and intermittent contact between anode metal 32 and container 16. Maximum conductivity results in efficient plating at high current levels. Forming container 16 of open-mesh titanium or other corrosion resistant metal obviates the need for periodic cleaning.

The anode basket 12 of the present invention provides increased current flow through solution 14 and faster, more efficient plating. The large surface area of container 16 and the large area of contact between cable rod 44 and flanges 28 of container 16 enhances current flow in an embodiment in the range of 100 to 150 amperes. Further, the surface area of the open mesh of container 16 and the positioning of the connection between rod 44 and container 16 below the surface of solution 14 provides improved heat dissipation. The grooved connection between rod 44 and sleeve 48 ensures a large area of contact between rod 44 and sleeve 48 which accommodates high current flow. The layers of insulation encapsulating splice 48 including rubber insulator 58, tape 60 and shrink wrap 62, protect the electrical connection between rod 44 and wire 40 against the corrosive effects of solution 14 which ensures low resistance and efficient transfer of electricity.

While this invention has been described as having an exemplary embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An anode basket comprising:

rigid container means formed of a conductive corrosion resistant material having a substantially open grid construction for submerging anode metal deposited therein in a plating solution;

a flexible electrical cable for connecting said container means to an electrical power source;

a hanger for supporting said container means in said plating solution; and an electrical connection fixedly attaching said cable to said container, said electrical connection being within said plating solution when the container is supported within the plating solution by said hanger.

2. The anode basket of claim 1 further comprising a second cable adapted for connection to said electrical power source fixedly attached at another location thereon which will be within said plating solution when the container is so submerged.

3. The anode basket of claim 1 wherein said container means includes sidewalls and a bottom wall defining an elongated substantially rectangular shape having an open upper end.

4. The anode basket of claim 3 wherein said bottom wall slants downwardly with distance from said open upper end.

5. The anode basket of claim 1 wherein said electrical connection includes a rod formed of conductive corrosion resistant material attached to said container, and splicing means for joining said cable to said rod.

6. The anode basket of claim 5 wherein said splicing means is an electrically conductive cylindrical sleeve having one end receiving said rod and another end receiving said cable, said rod having grooves formed therein, said sleeve having parts press fitted into said grooves.

7. The anode basket of claim 6 wherein said cylindrical sleeve and portions of said rod and said wire immediately adjacent thereto are encapsulated by a non-conductive, liquid impenetrable material.

8. The anode basket of claim 5 wherein said rod extends from said splicing means and is there fixedly attached to said container.

* * * * *